US007679587B2

(12) United States Patent
Kwak

(10) Patent No.: US 7,679,587 B2
(45) Date of Patent: *Mar. 16, 2010

(54) PIXEL CIRCUIT AND LIGHT EMITTING DISPLAY USING THE SAME

(75) Inventor: Won Kyu Kwak, Seongnam (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 916 days.

This patent is subject to a terminal disclaimer.

(21) Appl. No.: 11/274,062

(22) Filed: Nov. 14, 2005

(65) Prior Publication Data

US 2006/0124944 A1 Jun. 15, 2006

(30) Foreign Application Priority Data

Nov. 22, 2004 (KR) ..... 10-2004-0095978

(51) Int. Cl.
*G09G 3/32* (2006.01)

(52) U.S. Cl. ..... 345/82

(58) Field of Classification Search ..... 345/82, 345/205, 206; 313/500, 169.3
See application file for complete search history.

(56) References Cited

U.S. PATENT DOCUMENTS 5,952,789 A 9/1999 Stewart et al.
6,323,598 B1 * 11/2001 Guthrie et al. ..... 315/200 A
6,421,033 B1 7/2002 Williams et al.
6,618,031 B1 * 9/2003 Bohn et al. ..... 345/83
6,919,681 B2 * 7/2005 Cok et al. ..... 313/500
2002/0021293 A1 2/2002 Tam
2002/0109457 A1 * 8/2002 Duineveld et al. ..... 313/504
2003/0214469 A1 11/2003 Kageyama et al.
2004/0070557 A1 4/2004 Asano et al.
2005/0024305 A1 2/2005 Park
2005/0062696 A1 3/2005 Lo
2005/0093791 A1 5/2005 Lo
2005/0168491 A1 8/2005 Takahara et al.
2006/0097965 A1 * 5/2006 Deane et al. ..... 345/76

FOREIGN PATENT DOCUMENTS

JP 2002-215096 7/2002

(Continued)

OTHER PUBLICATIONS

Patent Abstracts of Japan, Publication No. 2003-043999; Publication Date Feb. 14, 2003; in the name of Suzuki.

(Continued)

*Primary Examiner*—Richard Hjerpe
*Assistant Examiner*—Shaheda A Abdin
(74) *Attorney, Agent, or Firm*—Christie, Parker & Hale, LLP

(57) ABSTRACT

A light emitting display includes a plurality of light emitting diodes within a pixel. A drive circuit is coupled to the plurality of light emitting diodes and generates a drive current flowing through the light emitting diodes corresponding to a data current. A switch circuit assembly is coupled to the plurality of light emitting diodes and the drive circuit and sequentially transfers the drive current from the drive circuit to the plurality of light emitting diodes. The light emitting diodes sequentially emit light. When all the light emitting diodes emit light, one frame is formed.

24 Claims, 9 Drawing Sheets

FOREIGN PATENT DOCUMENTS

| | | | |
|---|---|---|---|
| JP | 2003-43999 | | 2/2003 |
| JP | 2003-122306 | | 4/2003 |
| JP | 2003-140612 | | 5/2003 |
| JP | 2003-150082 | | 5/2003 |
| JP | 2003-150104 | | 5/2003 |
| JP | 2003-216100 | | 7/2003 |
| JP | 2004-029791 | | 1/2004 |
| WO | WO 03/077231 | A2 | 9/2003 |
| WO | WO 03/091978 | | 11/2003 |

OTHER PUBLICATIONS

Singapore Office action dated Sep. 21, 2007, for CN 2005101268174, with English translation.

Patent Abstracts of Japan, Publication No. 2002-215096, dated Jul. 31, 2002, in the name of Oh-Kyong Kwon.

U.S. Notice of Allowance dated Oct. 1, 2008, for related U.S. Appl. No. 11/274,041, indicating relevance of listed U.S. references in this IDS (except U.S. Publication 2005/0093791).

Japanese Office action dated Apr. 7, 2009, for corresponding Japanese application 2005-275852, noting listed references in this IDS.

* cited by examiner

PIXEL CIRCUIT AND LIGHT EMITTING DISPLAY USING THE SAME

CROSS-REFERENCE TO RELATED APPLICATIONS

This application claims priority to and the benefit of Korean Patent Application No. 10-2004-95978, filed on Nov. 22, 2004, in the Korean Intellectual Property Office, the entire disclosure of which is incorporated herein by reference.

BACKGROUND a) Field of the Invention

The present invention relates to a pixel circuit and a light emitting display, and more particularly, to a pixel circuit and a light emitting display using the same, which emits light by a plurality of light emitting diodes coupled to one pixel circuit in order to improve the aperture ratio of the light emitting display.

b) Discussion of Related Art

In recent years, various display devices having reduced weight and volume compared to those of a cathode ray tube have been developed. In particular, light emitting displays having excellent light-emission, a wide angle of visibility, and a high-speed response have been proposed as next-generation planar type display devices.

A light emitting diode has a structure in which a light emitting layer emitting light is disposed between a cathode electrode and an anode electrode. Electrons and holes are injected from the cathode electrode and the anode electrode into the light emitting layer and are recombined to produce an exciton. When the exciton falls down to a lower energy level, light is emitted.

In such a light emitting diode, the light emitting layer may be composed of organic materials or inorganic materials. The light emitting diode may be an organic light emitting diode or an inorganic light emitting diode according to its material and structure.

FIG. 1 is a circuit diagram showing a part of an image display device in which a current programming type pixel circuit is used. Referring to FIG. 1, the image display device includes four pixels formed adjacent to each other. Each of the pixels includes an organic light emitting diode (OLED) and a pixel circuit. The pixel circuit includes a first transistor T1 through a fourth transistor T4, and a capacitor Cst. Each of the first transistor T1 through the fourth transistor T4 includes a gate, a source, and a drain. The capacitor Cst includes a first electrode and a second electrode.

The four pixels have the same structure. In an upper most left pixel, the first transistor T1 is coupled to the OLED and transfers a current for light emission to the OLED.

The amount of current transferred by the first transistor T1 is controlled by a data current applied through a second transistor T2. The data current is maintained for a predetermined time by a capacitor Cst coupled between a gate and a source of the first transistor T1.

A scan line Sn is coupled to gates of the second and third transistors T2 and T3. A data line Dm is coupled to a source side of the second transistor T2. A light emitting control line En is coupled to the gate of the fourth transistor T4.

Operation of the above-described pixel circuit will now be described. When a scan signal sn applied to gates of the second and third transistors T2 and T3 becomes low and the second and third transistors T2 and T3 are turned on, the first transistor T1 is diode-coupled and a voltage corresponding to a data current value Idata is stored in the capacitor Cst.

After the scan signal sn becomes high, the second and third transistors T2 and T3 are turned off, a light emitting control signal en becomes low, and the fourth transistor T4 is turned on, a power is supplied and a current from the first transistor T1 corresponding to a voltage stored in the capacitor Cst flows through the OLED to emit light. At this time, the current flowing through the OLED is expressed by the following Equation 1.

$$Idata = \frac{\beta}{2}(Vgs - Vth)^2 = I_{OLED} \tag{1}$$

where Idata is a data current, Vgs is a voltage between the source and the gate of the first transistor T1, Vth is a threshold voltage of the first transistor T1, $I_{OLED}$ is a current flowing through the OLED, and β is a gain factor of the first transistor T1.

As indicated in Equation 1, although the threshold voltage Vth and a mobility of the first transistor T1 are non-uniform, since the current $I_{OLED}$ flowing through the OLED is identical to the data current Idata, uniform display characteristics can be obtained if a write current source of a data drive is uniform through the entire panel.

However, the current programming type pixel circuit mentioned above has a problem in that it takes a substantial amount of time to charge the data line since it should control a very small current. For example, assuming that a load capacitance of a data line is 30 pF, it takes a few milliseconds to charge a load of the data line with a current from several tens of nAs to several hundreds of nAs. Since a line time is only several tens of microseconds, there is not sufficient time to charge this load to the data line. In particular, when a low luminance is displayed, since a current value is small, a longer time is required to charge the load of the data line.

Furthermore, in a conventional pixel circuit in which a light emitting display is used, only one OLED is coupled to each pixel circuit. In order to emit a plurality of light emitting diodes, a plurality of pixel circuits are needed. Thus, the number of elements required within a light emitting display may be high.

Moreover, because one light emitting control line is coupled to each pixel row, the aperture ratio of a light emitting display may be deteriorated.

SUMMARY OF THE INVENTION

Accordingly, it is an aspect of the present invention to provide a light emitting display, which reduces a current write time while having a low luminance value by increasing a current amount of a data signal. Other aspects of the present invention reduce the number of elements, increase the aperture ratio, and minimize color separation in the light emitting display by connecting a plurality of light emitting diodes to each pixel circuit.

In one aspect of the invention, a pixel includes a first light emitting diode, a second light emitting diode, and a drive circuit coupled to the first and second light emitting diodes for generating a drive current flowing through the first and second light emitting diodes corresponding to a data current. A first switch circuit is coupled to the first light emitting diode and the drive circuit for transferring the drive current from the drive circuit to the first light emitting diode. A second switch circuit is coupled to the second light emitting diode and the drive circuit for transferring the drive current from the drive circuit to the second light emitting diode. The first and second light emitting diodes sequentially emit light.

According to a second aspect of the present invention, a light emitting display includes first through fourth light emitting diodes, and a drive circuit coupled to the first through fourth light emitting diodes for generating a drive current flowing through the light emitting diodes corresponding to a data current. A switch circuit is coupled to the first through fourth light emitting diodes and the drive circuit for sequentially controlling the drive current flowing through the first through fourth light emitting diodes.

According to a third aspect of the present invention, a light emitting display includes an image display device with a first pixel as described above, a data driver for transferring a data signal to the pixel; and a scan driver for transferring a scan signal and first through third light emitting control signals to the pixel.

BRIEF DESCRIPTION OF THE DRAWINGS

These and/or other aspects of the invention will become apparent and more readily appreciated from the following description of examples of embodiments, taken in conjunction with the accompanying drawings of which.

DETAILED DESCRIPTION

Figure 1:
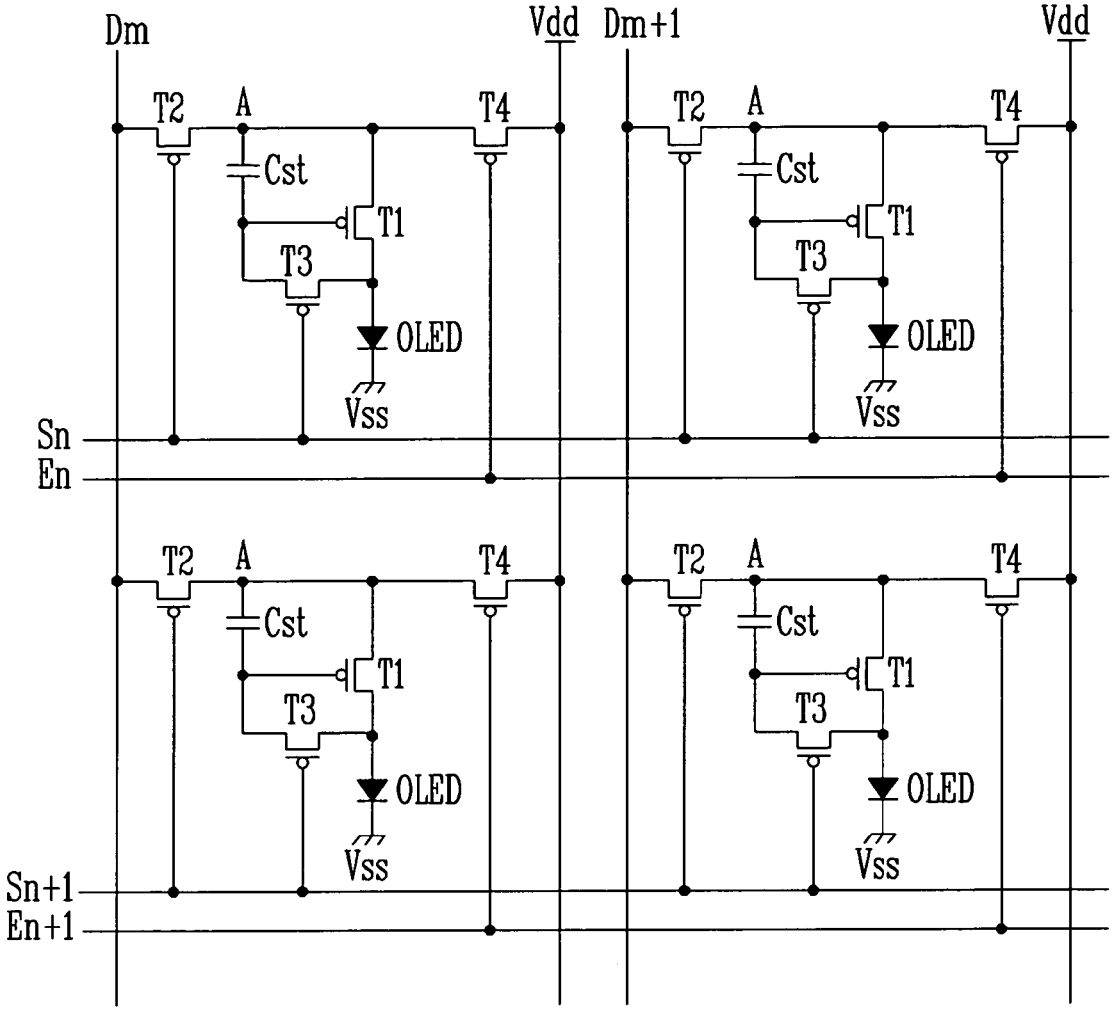
FIG. 1 (PRIOR ART)
FIG. 1 is a circuit diagram showing a part of a conventional image display device in which a current write type pixel circuit is used.

Hereinafter, examples of embodiments according to the present invention will be described with reference to the accompanying drawings. Hereinafter, elements described as connected to another element may be connected directly or through one or more intervening elements. Like reference numerals refer to like elements, and descriptions of common elements that are well-known in the art are omitted for clarity.

Figure 2:
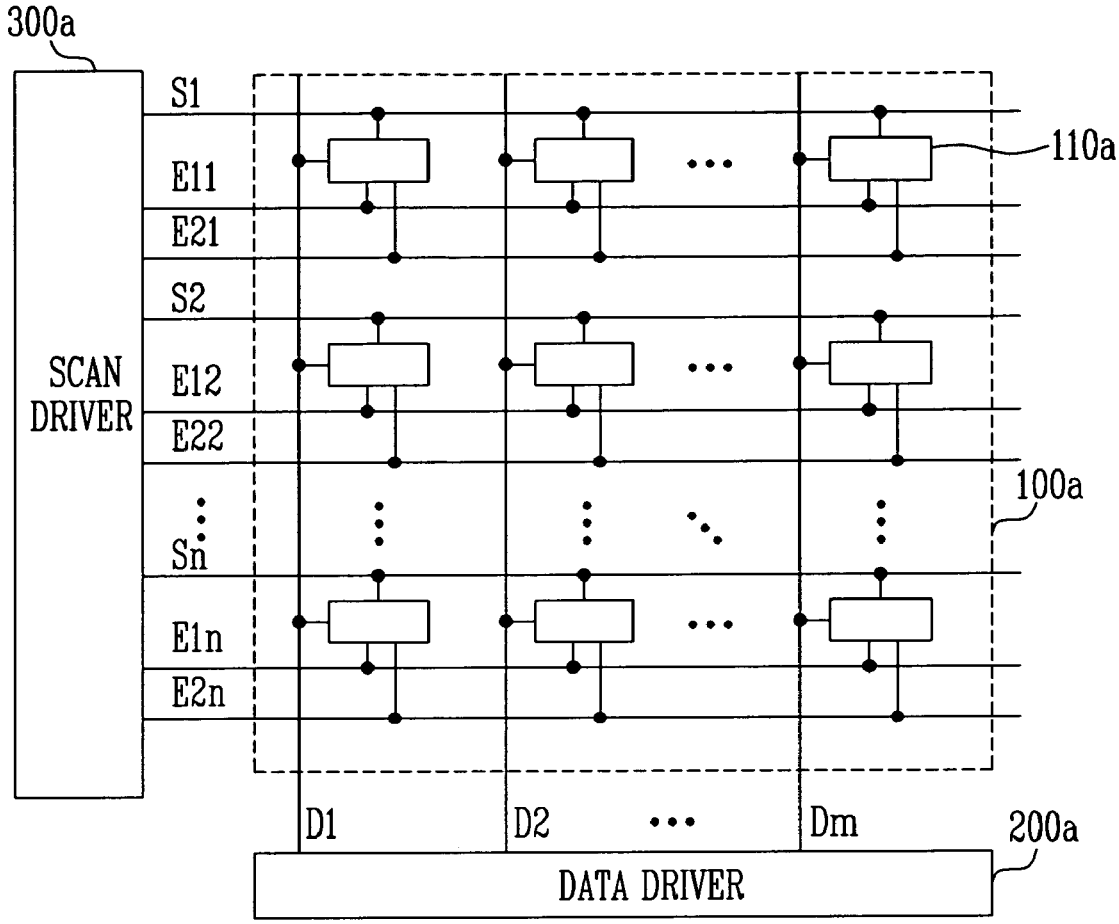
FIG. 2 is a schematic view showing a structure of a light emitting display according to a first embodiment of the present invention.

FIG. 2 is a schematic view showing a structure of a light emitting display according to a first embodiment of the present invention. With reference to FIG. 2, the light emitting display includes an image display device 100*a*, a data driver 200*a*, and a scan driver 300*a*.

The image display device 100*a* includes a plurality of pixels 110*a*, a plurality of scan lines S1, S2, S3, . . . Sn-1, Sn, a plurality of first light emitting control lines E11, E12, . . . E1*n*-1, E1*n* and a plurality of second light emitting control lines E21, E22, . . . E2*n*-1, E2*n* all arranged in a column direction. The device also includes a plurality of data lines D1, D2, . . . Dm-1, Dm arranged in a row direction, and a plurality of pixel power lines (not shown) for supplying power to the pixels. Each of the power lines receives external power and supplies it to the pixels.

When a data signal is transferred to a pixel 110*a* through the data lines D1, D2, . . . Dm-1, Dm according to a scan signal on the scan lines S1, S2, S3, . . . Sn-1, Sn, the pixel 110*a* generates a drive current corresponding to the data signal. The drive current is transferred to an OLED according to a light emitting control signal transferred through the first light emitting control lines E11, E12, . . . E1*n*-1, E1*n* and the second light emitting control lines E21, E22, . . . E2*n*-1, E2*n* to display an image.

The data driver 200*a* is connected to the data lines D1, D2, . . . Dm-1, Dm, and transfers the data signal to the image display device 100*a*. Further, the data driver 200*a* sequentially transfers red and green data, green and blue data, or blue and red data on one data line.

The scan driver 300*a* is installed at a side of the image display device 100*a*. The scan driver 300*a* is connected to a plurality of scan lines S1, S2, S3, . . . Sn-1, Sn, a plurality of first light emitting control lines E11, E12, . . . E1*n*-1, E1*n* and a plurality of second light emitting control lines E21, E22, . . . E2*n*-1, E2*n*, and transfers a scan signal and a light emitting control signal to the image display device 100*a*.

Figure 3:
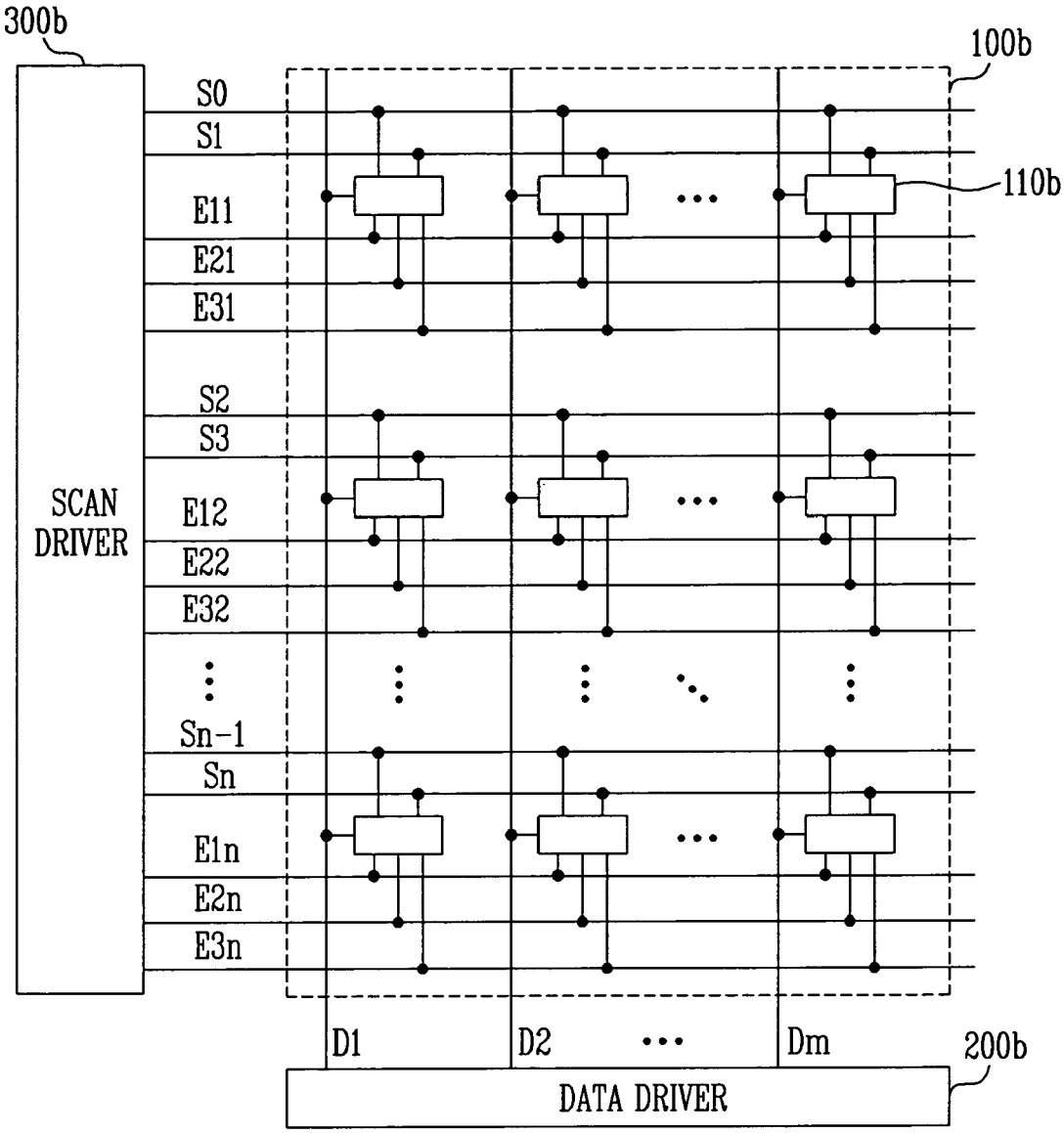
FIG. 3 is a schematic view showing a structure of a light emitting display according to a second embodiment of the present invention.

FIG. 3 is a schematic view showing a structure of a light emitting display according to a second embodiment of the present invention. Referring to FIG. 3, the light emitting display includes an image display device 100*b*, a data driver 200*b*, and a scan driver 300*b*.

The image display device 100*b* includes a plurality of pixels 110*b*, a plurality of scan lines S0, S1, S2, . . . Sn-1, Sn, a plurality of first light emitting control lines E11, E12, . . . E1*n*-1, E1*n*, a plurality of second light emitting control lines E21, E22, . . . E2*n*-1, E2*n*, and a plurality of third light emitting control lines E31, E32, . . . E3*n*-1, E3*n* all arranged in a column direction. The device also includes a plurality of data lines D1, D2, . . . Dm-1, Dm arranged in a row direction, and a plurality of pixel power lines (not shown) for supplying power to the pixels. Each of the power lines receives external power and supplies it to the pixels.

When a data signal is transferred to a pixel 110*b* through the data lines D1, D2, . . . Dm-1, Dm according to a scan signal on the scan lines S0, S1, S2, . . . Sn-1, Sn, the pixel 110*b* generates a drive current corresponding to the data signal. The drive current is transferred to an OLED according to a light emitting control signal transferred through the first light emitting control lines E11, E12, . . . E1*n*-1, E1*n* through the third light emitting control lines E31, E32, . . . E3*n*-1, E3*n* to display an image on the image display device 100*b*.

The data driver 200*b* is connected to the data lines D1, D2, . . . Dm-1, Dm, and transfers the data signal to the image display device 100*b*. Further, the data driver 200*b* sequentially transfers red and green data, green and blue data, or blue and red data on one data line.

The scan driver 300*b* is installed at a side of the image display device 100*b*. The scan driver 300*b* is connected to a plurality of scan lines S0, S1, S1, . . . Sn-1, Sn, a plurality of first light emitting control lines E11, E12, . . . E1*n*-1, E1*n*, a plurality of second light emitting control lines E21, E22, . . . E2*n*-1, E2*n*, and a plurality of third light emitting control lines E31, E32, . . . E3*n*-1, E3*n*, and transfers a scan signal and a light emitting control signal to the image display device 100*b*.

Figure 4:
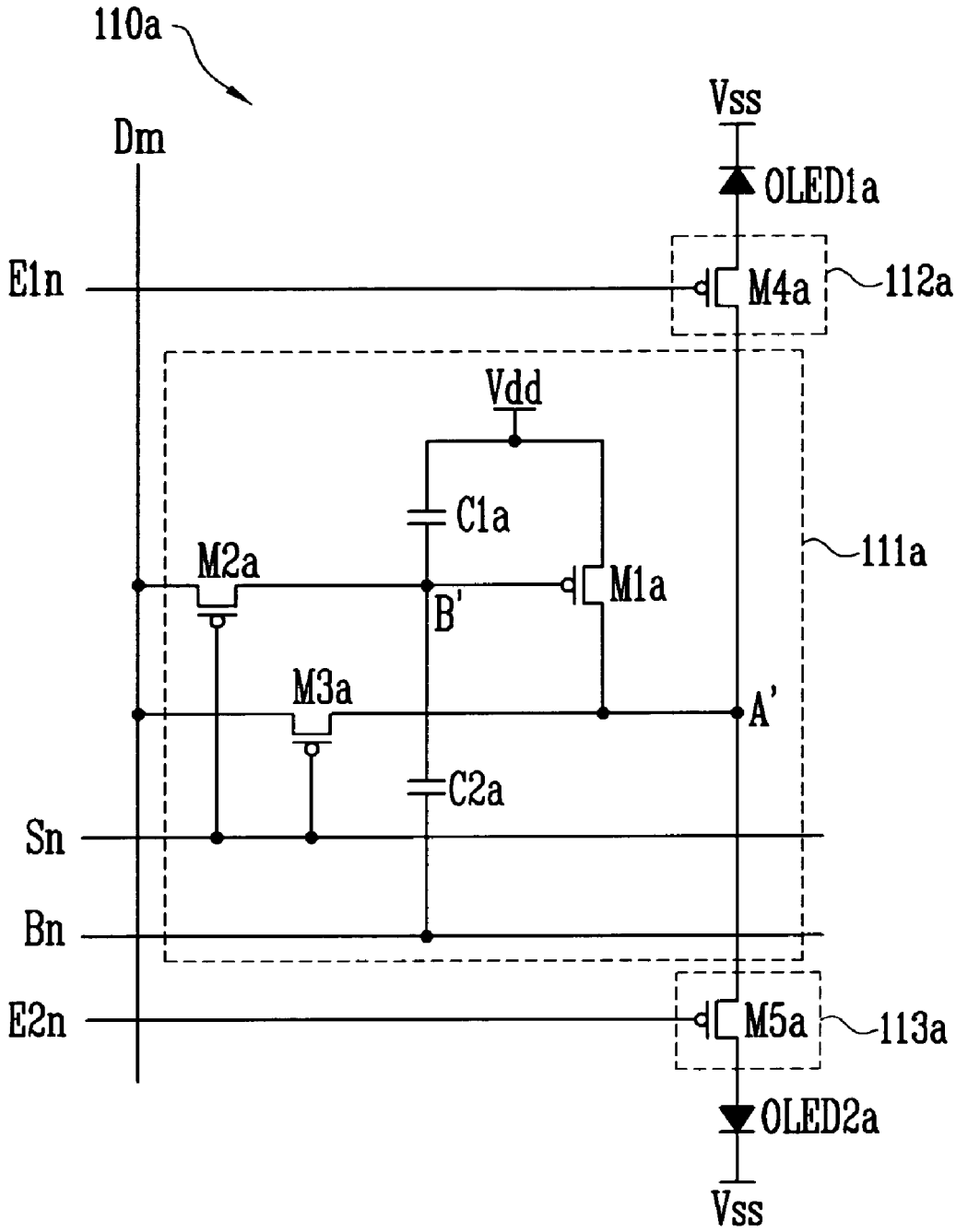
FIG. 4 is circuit diagram showing a first example of a pixel used in the light emitting display of FIG. 2.

FIG. 4 is circuit diagram showing a first example of a pixel used in the light emitting display shown in FIG. 2. Referring to FIG. 4, the pixel 110*a* includes a light emitting diode and a pixel circuit. Two OLEDs are connected to one pixel circuit. Each pixel circuit includes first through fifth transistors M1*a* through M5*a*, and first and second capacitors C1*a* and C2*a*.

The pixel circuit is divided into a drive circuit 111*a*, a first switch circuit 112*a*, and a second switch circuit 113*a*. The drive circuit 111*a* includes the first through third transistors M1*a* through M3*a*, and the first and second capacitors C1*a* and C2*a*. The first switch circuit 112*a* includes the fourth transistor M4*a*. The second switch circuit 113*a* includes the fifth transistor M5*a*.

The first through fifth transistors M1*a* through M5*a* are PMOS transistors. Since each source and drain of the first through fifth transistors M1*a* through M5*a* have the same physical characteristics, the source and drain can be called first and second electrodes, respectively. Further, the first and second capacitors C1*a* and C2*a* each include first and second electrodes. Two light emitting diodes are referred to herein as first and second light emitting diodes OLED1*a* and OLED2*a*, respectively.

A source of the first transistor M1*a* is connected to a pixel power line Vdd, a drain thereof is connected to a first node A', and a gate thereof is connected to a second node B'. The first transistor M1*a* provides a current to the first node A' according to a voltage applied to the second node B'.

A source of the second transistor M2*a* is connected to a data line Dm, a drain thereof is connected to the second node B', and a gate thereof is connected to a scan line Sn. The second transistor M2*a* provides a data signal to the second node B' according to a scan signal transferred through the scan line Sn.

A source of the third transistor M3*a* is connected to the first node A', a drain thereof is connected to the data line Dm, and a gate thereof is connected to the scan line Sn. The third transistor M3*a* allows a current flowing from the first transistor M1*a* to flow from the source of the third transistor M3*a* to the drain thereof.

The first electrode of the first capacitor C1*a* is connected to the pixel power line Vdd, and the second electrode thereof is connected to the second node B'. The first capacitor C1*a* maintains a voltage corresponding to a data signal for a predetermined time.

The first electrode of the second capacitor C2*a* is connected to the second node B', and the second electrode thereof is connected to a boosting signal line Bn. The second capacitor C2*a* changes a gate voltage of the first transistor M1*a* according to a boosting signal.

A source of the fourth transistor M4*a* is connected to the first node A', a drain thereof is connected to the first light emitting diode OLED1*a*, and a gate thereof is connected to the first light emitting control line E1*n*. The fourth transistor M4*a* transfers a current to the first light emitting diode OLED1*a*according to a first light emitting control signal e1*n* transferred through the first light emitting control line E1*n* wherein the current has been generated by the first transistor and allowed to flow into the first node A'.

A source of the fifth transistor M5*a* is connected to the first node A', a drain thereof is connected to the second light emitting diode OLED2*a*, and a gate thereof is connected to a second light emitting control line E2*n*. The fifth transistor M5*a* transfers a current to the second light emitting diode OLED2*a* according to a second light emitting control signal e2*n* transferred through the second light emitting control line E2*n* wherein the current has been generated by the first transistor M1*a* and has been allowed to flow into the first node A'.

Figure 5:
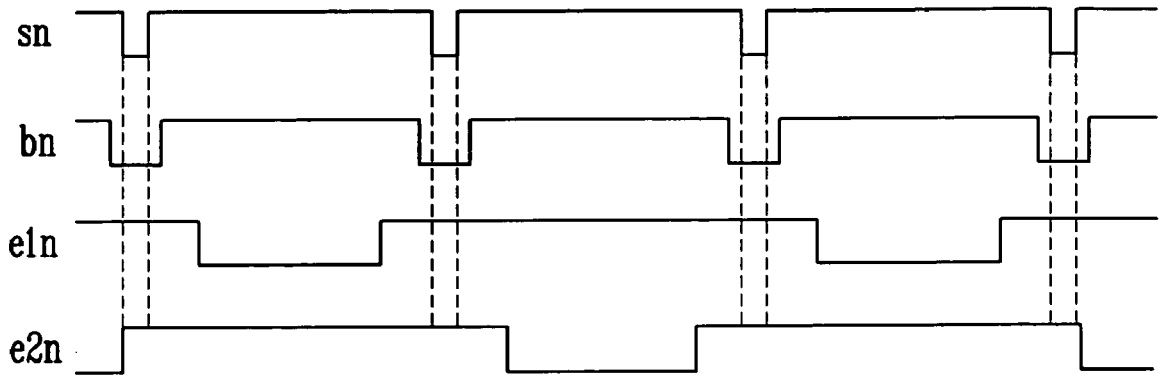
FIG. 5 is a waveform of signals transferred to a light emitting display in which the pixel of FIG. 4 is used.

FIG. 5 is a waveform of signals transferred to a light emitting display in which the pixel of FIG. 4 is used. Referring to FIGS. 4 and 5, the pixel operates according to a scan signal sn, a data signal, a boosting signal bn, and first and second light emitting control signals e1*n* and e2*n*.

First, during a period when the first and second light emitting control signals e1*n* and e2*n* are all at a high level, the boosting signal bn falls to a low level. When the scan signal sn falls to a low level, the second transistor M2*a* and the third transistor M3*a* are turned on, which causes the data current Idata to flow from a source of the first transistor M1*a* to a drain of the first transistor M1*a*. At this time, according the flowing data current Idata, a voltage between the source of the first transistor M1*a* and a gate of the first transistor M1*a* changes. The voltage between the source of the first transistor M1*a* and a gate of the first transistor M1*a* is expressed by a following Equation 2.

$$Idata = \frac{\beta}{2}(Vgs - Vth)^2 \quad Vgs = \sqrt{\frac{2\,Idata}{\beta}} + Vth \tag{2}$$

where Idata is a data current, Vgs is a voltage between the source and the gate of the first transistor M1*a*, Vth is a threshold voltage of the first transistor M1*a*, and β is a gain factor of the first transistor M1*a*.

After the second transistor M2*a* and the third transistor M3*a* are turned off according to the scan signal sn, and when the fourth transistor M4*a* is turned on according to the first light emitting control signal e1*n*, a current flowing through the first transistor M1*a* flows through the fourth transistor M4*a* to thereby emit light.

In this case, when the second transistor M2*a* is turned off, a gate voltage of the first transistor M1*a* is increased by coupling the first capacitor C1*a* and the second capacitor C2*a*. The increased voltage is expressed by a following Equation 3.

$$\Delta Vg = \frac{\Delta Vselect \cdot C2a}{C1a + C2a} \tag{3}$$

where ΔVg is a gate voltage of the first transistor M1*a* which is increased by coupling of the first capacitor C1*a* and the second capacitor C2*a*, ΔVselect is a voltage amplitude of a selection signal.

When the first light emitting control signal e1*n* falls to a low state, the fourth transistor M4*a* is turned on, so that a current flows through the first light emitting diode OLED1*a*. The current flowing through the first light emitting diode OLED1*a* is expressed by a following Equation 4.

$$I_{OLED} = \frac{\beta}{2}(Vgs - \Delta Vg - Vth)^2 \tag{4}$$

where, $I_{OLED}$ is a current flowing through the first light emitting diode OLED1*a*, Vgs is a voltage between a source and a gate of the first transistor M1*a* when a data current flows through the first transistor M1*a*, ΔVg is a gate voltage increased by coupling the first capacitor C1*a* and the second capacitor C2*a*, Vth is a threshold voltage of the first transistor M1*a*, and β is a gain factor of the first transistor M1*a*.

As can seen from the Equations 3 and 4, a large data current adjusts a current of the first light emitting diode OLED1*a*. Namely, a large current is supplied to a data line to allow the charge time of the data line to occur during the line time.

When the scan signal and the boosting signal again fall to a low level and the first and second light emitting control signals rise to a high level, a pixel circuit again operates to generate a data current expressed by the Equation 2. When the scan signal and the boosting signal rise to a high level and the second light emitting control signal falls to a low level, the fifth transistor M5*a* is turned on, which causes the current expressed by the Equation 4 to flow through the second light emitting diode OLED2*a*.

Figure 6:
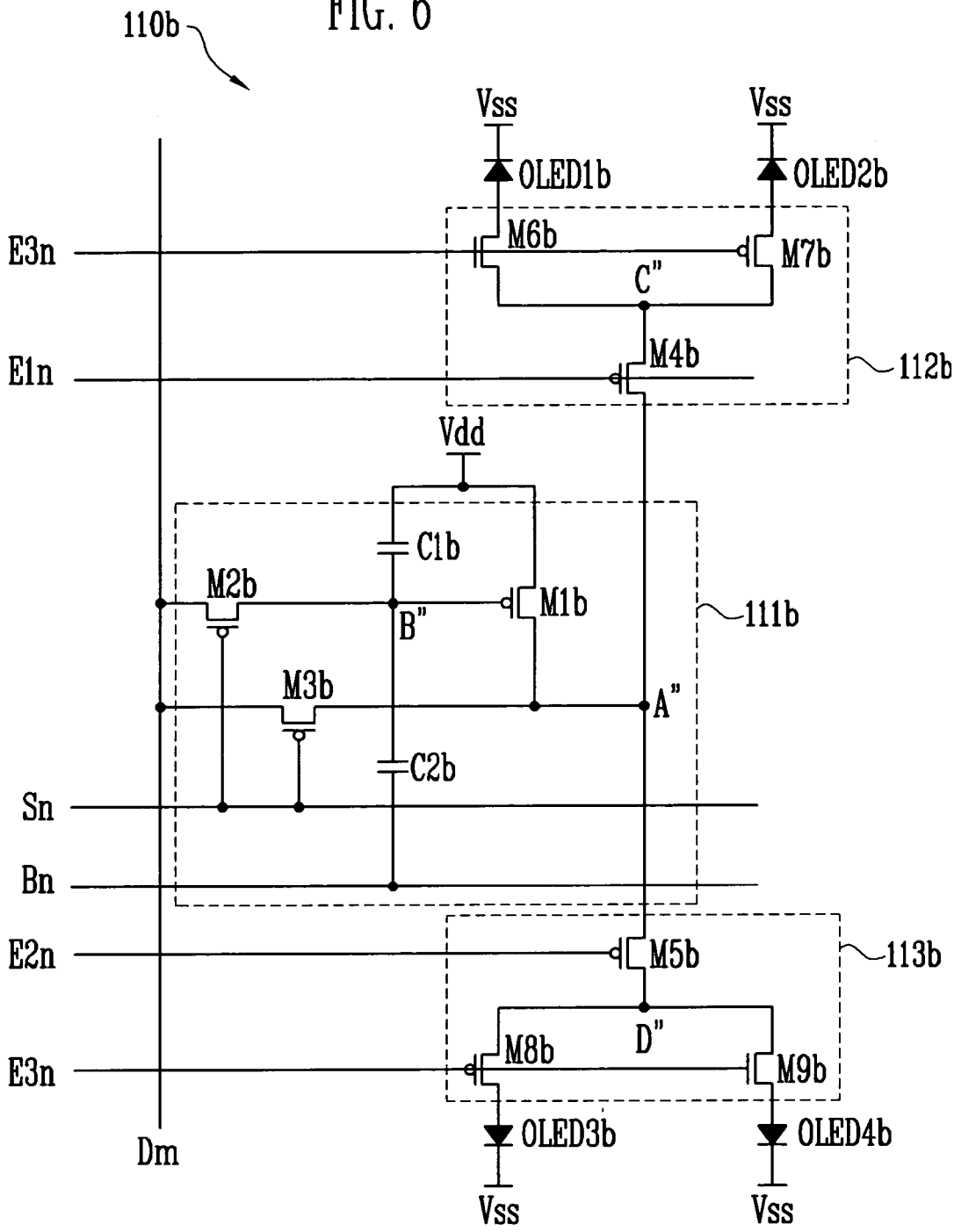
FIG. 6 is circuit diagram showing a first example of a pixel used in the light emitting display of FIG. 3.

FIG. 6 is circuit diagram showing a first example of a pixel used in the light emitting display shown in FIG. 3. With reference to FIGS. 3 and 6, the pixel 110*b* includes a light emitting diode and a pixel circuit. Four light emitting diodes OLEDs are connected to one pixel circuit. Each pixel 110*b* includes a first transistor M1*b* through a ninth transistor M9*b*, and a first capacitor C1*b* and a second capacitor C2*b*.

The pixel circuit is divided into a drive circuit 111*b*, a first switch circuit 112*b*, and a second switch circuit 113*b*. The drive circuit 111*b* includes first through third transistors M1*b* to M3*b*, a first capacitor C1*b* and a second capacitor C2*b*. The first switch circuit 112*b* includes fourth through sixth transistors M4*b* to M6*b*. The second switch circuit 113*b* includes seventh through ninth transistors M7*b* to M9*b*.

The first to fifth transistors M1*b* to M5*b*, and the seventh and eighth transistors M7*b* and M8*b* are PMOS transistors, whereas the sixth and ninth transistors M6*b* and M9*b* are NMOS transistors. Since each source and drain of the first through ninth transistors M1*b* through M9*b* have the same physical characteristics, the source and drain are each referred to herein as the first and second electrodes, respectively. In addition, the first and second capacitors C1*b* and C2*b* each include first and second electrodes. Four light emitting diodes are referred to herein as first through fourth light emitting diodes OLED1*b* through OLED4*b*.

A source of the first transistor M1*b* is connected to a pixel power line Vdd, a drain thereof is connected to a first node A", and a gate thereof is connected to a second node B". The first transistor M1*b* provides a current to the first node A" according to a voltage applied to the second node B".

A source of the second transistor M2*b* is connected to a data line Dm, a drain thereof is connected to the second node B", and a gate thereof is connected to a scan line Sn. The second transistor M2*b* provides a data signal to the second node B" according to a scan signal transferred through the scan line Sn.

A source of the third transistor M3*b* is connected to the first node A", a drain thereof is connected to the data line Dm, and a gate thereof is connected to the scan line Sn. The third transistor M3*b* allows a current flowing from the first transistor M1*b* to flow from the source of the third transistor M3*b* to the drain thereof.

The first electrode of the first capacitor C1*b* is connected to the pixel power line Vdd, and the second electrode thereof is connected to the second node B". The first capacitor C1*b* maintains a voltage corresponding to a data signal for a predetermined time.

The first electrode of the second capacitor C2*b* is connected to the second node B", and the second electrode thereof is connected to a boosting signal line Bn. The second capacitor C2*b* changes a gate voltage of the first transistor M1*b* according to a boosting signal.

A source of the fourth transistor M4*b* is connected to the first node A", a drain thereof is connected to a third node C", and a gate thereof is connected to a first light emitting control line E1*n*. The fourth transistor M4*b* selectively transfers a current flowing through the first node A" to the third node C" according to a first light emitting control signal e1*n* transferred through the first light emitting control line E1*n*.

A source of the fifth transistor M5*b* is connected to the first node A", a drain thereof is connected to a fourth node D", and a gate thereof is connected to a second light emitting control line E2*n*. The fifth transistor M5*b* selectively transfers a current flowing through the second node B" to the fourth node D" according to a second light emitting control signal e2*n* transferred through the first light emitting control line E2*n*.

A source of the sixth transistor M6*b* is connected to the third node C", a drain thereof is connected to the first light emitting diode OLED1*b*, and a gate thereof is connected to a third light emitting control line E3*n*. The sixth transistor M6*b* selectively transfers a current transferred to the third node C" to the first light emitting diode OLED1*b* according to a third light emitting control signal e3*n* supplied through the third light emitting control line E3*n*.

A source of the seventh transistor M7*b* is connected to the third node C", a drain thereof is connected to the second light emitting diode OLED2*b*, and a gate thereof is connected to the third light emitting control line E3*n*. The seventh transistor M7*b* selectively transfers a current transferred to the third node C" to the second light emitting diode OLED2*b* according to the third light emitting control signal e3*n* supplied through the third light emitting control line E3*n*.

The sixth transistor M6*b* is an NMOS transistor, and the seventh transistor M7*b* is a PMOS transistor. The third light emitting control signal e3*n* causes either the sixth transistor M6*b* or the seventh transistor M7*b* to be turned on, so that either the first light emitting diode OLED1*b* or the second light emitting diode OLED2*b* emits light.

A source of the eighth transistor M8*b* is connected to the fourth node D", a drain thereof is connected to the third light emitting diode OLED3*b*, and a gate thereof is connected to the third light emitting control line E3*n*. The eighth transistor M8*b* selectively transfers a current transferred to the fourth node D" to the third light emitting diode OLED3*b* according to the third light emitting control signal e3*n* supplied through the third light emitting control line E3*n*.

A source of the ninth transistor M9*b* is connected to the fourth node D", a drain thereof is connected to the fourth light emitting diode OLED4*b*, and a gate thereof is connected to the third light emitting control line E3*n*. The ninth transistor M9*b* selectively transfers a current transferred to the fourth node D" to the fourth light emitting diode OLED4*b* according to the third light emitting control signal e3*n* supplied through the third light emitting control line E3*n*.

The eighth transistor M8*b* is a PMOS transistor, and the ninth transistor M9*b* is an NMOS transistor. The third light emitting control signal e3*n* causes one of the eighth transistor M8*b* and the ninth transistor M9*b* to be turned on, so that one of the third or fourth light emitting diodes OLED3*b* and OLED4*b* emits light.

Figure 7:
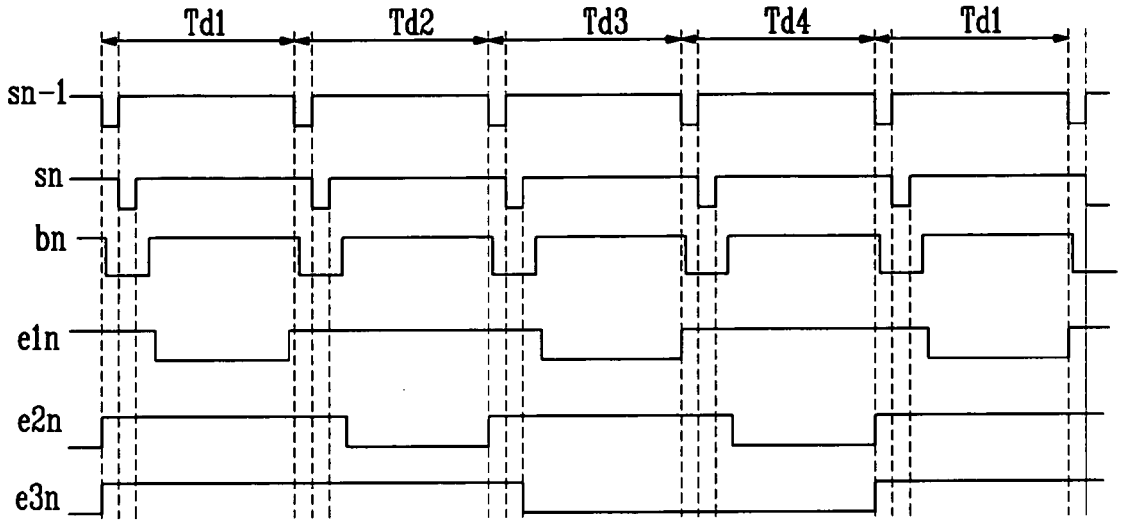
FIG. 7 is a waveform of signals transferred to a light emitting display in which the pixel circuit of FIG. 6 is used.

FIG. 7 is a waveform of signals transferred to a light emitting display in which the pixel circuit of FIG. 6 is used. Referring to FIGS. 6 and 7, the pixel operates according to a scan signal sn, a previous scan signal 2*n*-1, a data signal, a boosting signal bn, and first through third light emitting control signals e1*n* through e3*n*.

During a first period Td1, the first light emitting control signal e1*n* is in a low state, and the second and third light emitting control signals e2*n* and e3*n* are in a high state. During a second period Td2, the first and third light emitting control signals e1*n* and e3*n* are in a high state, and the second light emitting control signal e2*n* is in a low state. During a third period Td3, the first and third light emitting control signals e1*n* and e3*n* are in a low state, and the second light emitting control signal e2*n* is in a high state. During a fourth period Td4, the first light emitting control signal e1*n* is in a high state, and the second and third light emitting control signals e2*n* and e3*n* are in a low state. A scan signal sn is in a low state for a moment at a start of each period. A boosting signal bn falls to a low state at a point of time when the scan signal sn is in a low state.

First, a current expressed by the Equation 4 flows through the first light emitting diode OLED1*b* according to the first light emitting control signal e1*n* and the third light emitting control signal e3*n* during the first period Td1. A current expressed by the Equation 4 flows through the fourth light emitting diode OLED4*b* according to the second light emitting control signal e2*n* and the third light emitting control signal e3*n* during the second period Td2. A current expressed by the Equation 4 flows through the second light emitting diode OLED2 according to the first light emitting control signal e1*n* and the third light emitting control signal e3*n* during the third period Td3. Furthermore, a current expressed by the Equation 4 flows through the third light emitting diode OLED3 according to the second light emitting control signal e2*n* and the third light emitting control signal e3*n* during the fourth period Td4.

As shown in FIGS. 2 through 7, upon emitting light by adjusting a voltage between a source and a gate of the first transistor M1, M1*a*, M1*b* using a current, a time to charge the current is required. In comparison with the case that only one light emitting diode is connected to one pixel, emitting light with two light emitting diodes in each pixel reduces the light emitting time by ½. Further, in the case that four light emitting diodes emit light in each pixel, the light emitting time is reduced by ¼.

Accordingly, comparing this embodiment with the pixel of FIG. 1, the light emitting time is reduced, but allowing the same current to flow through the pixel would cause the luminance to deteriorate. Thus, in these embodiments having two or four light emitting diodes emitting light, a current of two or four times flows through the circuit. As a result, when the current is increased, a time that the current is charged in one pixel is shortened. In particular, a low gradation is expressed with a low current amount.

FIGS. 8A through 8D are views showing light emitting processes by the light emitting display shown in FIG. 6. An image display device 100 includes 3 vertically arranged pixels 110*b*, 110*b*', 110*b*" in which 12 light emitting diodes are arranged in 2×6 form. Each of the pixels 110*b*, 110*b*', 110*b*" are substantially the same as the pixel 110*b* shown in FIG. 6, and the elements of each of these pixels will thus be described in reference to FIGS. 6 and 7. An upper pixel is a first pixel 110*b*, a middle pixel is a second pixel 110*b*', and a lower pixel is a third pixel 110*b*". While one light emitting diode emits light for one frame period, 4 light emitting diodes sequentially emit light. Thus, one frame period can be divided into 4 sub-fields.

With reference to FIGS. 6 through 8D, the first pixel 110*b* is embodied by the sixth transistor M6*b*, the seventh transistor M7*b*, the eighth transistor M8*b*, and the ninth transistor M9*b*. The sixth and ninth transistors M6*b* and M9*b*receive the third light emitting control signal e3*n* and perform a switching operation. The sixth and ninth transistors M6*b* and M9*b* are NMOS transistors, and the seventh and eighth transistors M7*b* and M8*b* are PMOS transistors.

The second pixel 110*b*" is embodied by the sixth transistor M6*b* , the seventh transistor M7*b*, an eighth transistor M8*b*, and a ninth transistor M9*b*. Unlike the first pixel 110*b*, the sixth and ninth transistors M6*b* and M9*b* of the second pixel 110*b*' are PMOS transistors, and the seventh and eighth transistors M7*b* and M8*b* are NMOS transistors.

Figure 8A:
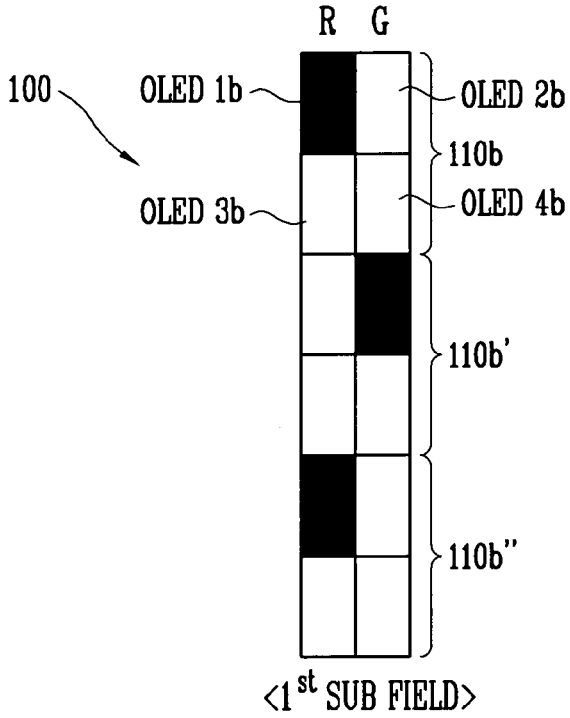
FIGS. 8A through 8D are views showing light emitting processes of the light emitting display of FIG. 6.

The third pixel 110*b*" is embodied by the sixth transistor M6*b*, the seventh transistor M7*b*, the eighth transistor M8*b*, and the ninth transistor M9*b*. Like the first pixel 110*b*, the sixth and ninth transistors M6*b* and M9*b* of the third pixel circuit 110*b*" are NMOS transistors, and the seventh and eighth transistors M7*b* and M8*b* are PMOS transistors. In addition, the first light emitting diode OLED1*b* and the third light emitting diode OLED3*b* of each pixel 110*b*, 110*b*', 110*b*" receive a red data signal and emit light, whereas the second light emitting diode OLED2*b* and the fourth light emitting diode OLED4*b* of each pixel receive a green data signal and emit light Consequently, FIG. 8A shows a first sub-field among four sub-fields. As shown in FIG. 8A, in the first pixel 110*b*, the first light emitting diode OLED1*b* connected to the sixth transistor M6*b* emits light. In the second pixel circuit 110*b*', the second light emitting diode OLED2*b* connected to the seventh transistor M7*b* emits light. In the third pixel 110*b*", the first light emitting diode OLED1*b* connected to the sixth transistor M6*b* emits light. As a result, in the first sub-field, the first light emitting diode OLED1*b* in the first pixel 110*b* and the third pixel 110*b*", emits light. The second light emitting diode OLED2*b* in the second pixel 110*b*' emits light, causing red and green light to be simultaneously emitted by means of the first and second light emitting diodes OLED1*b* and OLED2*b*.

Figure 8B:
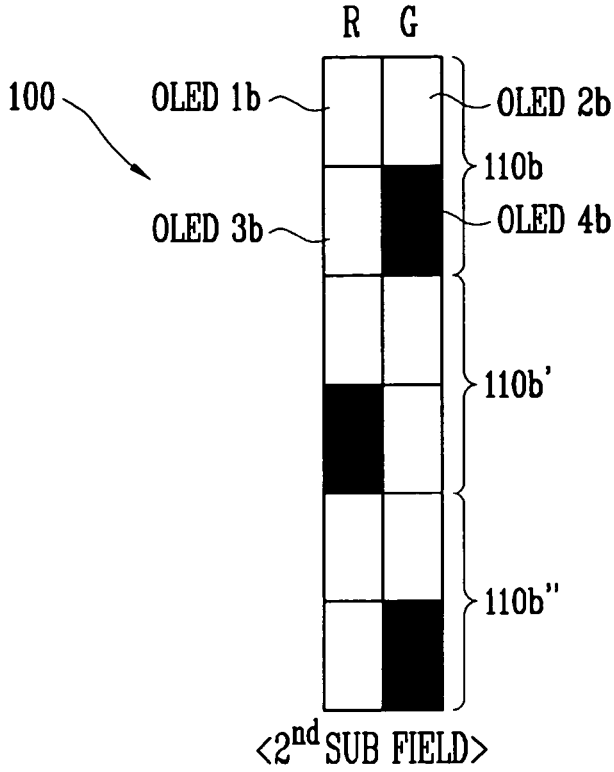

Furthermore, FIG. 8B shows a second sub-field among four sub-fields. As shown in FIG. 8B, in the first pixel 110*b*, the fourth light emitting diode OLED4*b* connected to the ninth transistor M9*b* emits light. In the second pixel 110*b*', the third light emitting diode OLED3*b* connected to the eighth transistor M8*b* emits light. In the third pixel 110*b*', the fourth light emitting diode OLED4*b* connected to the seventh transistor M7*b* emits light. As a result, in the second sub-field, the fourth light emitting diodes OLED4*b* in the first pixel 110*b* and the third pixel 110*b*" emit light. The third light emitting diode OLED3*b* in the second pixel 110*b*' emits light, causing red and green light to be simultaneously emitted by means of the third and fourth light emitting diodes OLED3*b* and OLED4*b*.

Figure 8C:
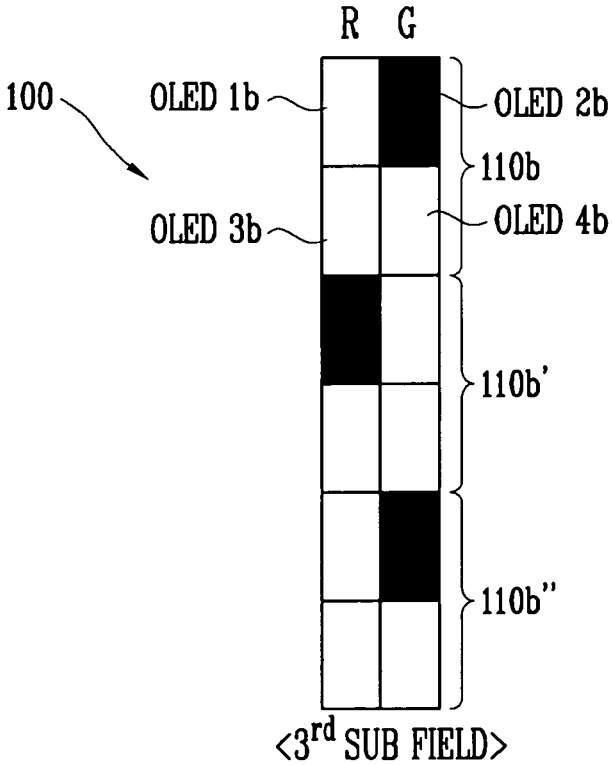

In addition, FIG. 8C shows a third sub-field among four sub-fields. As shown in FIG. 8C, in the first pixel 110*b*, the second light emitting diode OLED2*b* connected to the seventh transistor M7*b* emits light. In the second pixel 110*b*', the first light emitting diode OLED1*b* connected to the sixth transistor M6*b* emits light. In the third pixel 110*b*', the second light emitting diode OLED2*b* connected to the seventh transistor M7*b* emits light. As a result, in the third sub-field, red and green light are simultaneously emitted by means of the first and second light emitting diodes OLED1*b* and OLED2*b*.

Figure 8D:
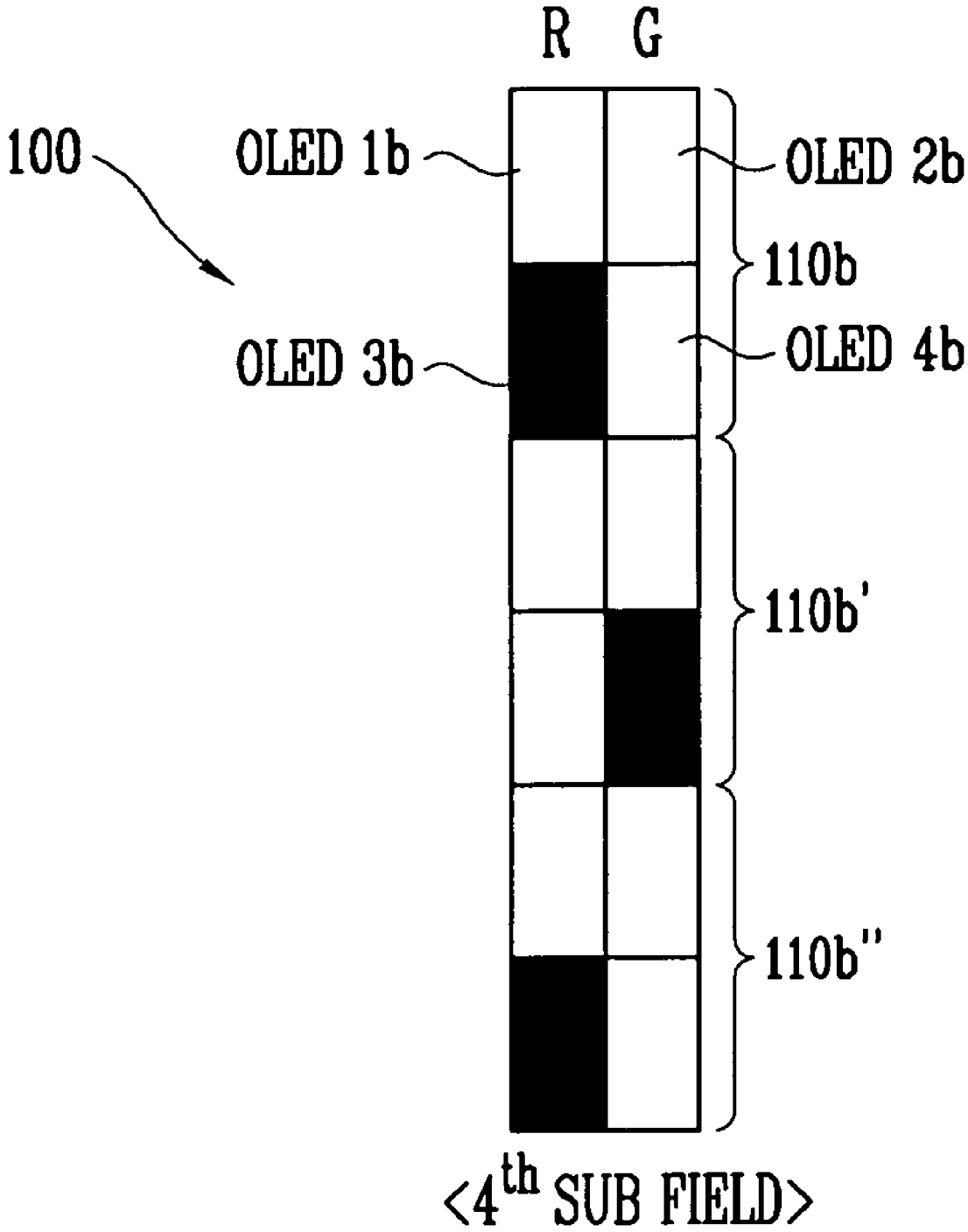

FIG. 8D shows a fourth sub-field among four sub-fields. As shown in FIG. 8D, in the first pixel 110*b*, the third light emitting diode OLED3*b* connected to the eighth transistor M8*b* emits light. In the second pixel 110*b*', the fourth light emitting diode OLED4*b* connected to the ninth transistor M9*b* emits light. In the third pixel 110*b*', the third light emitting diode OLED3*b* connected to the eighth transistor M8*b* emits light. As a result, in the fourth sub-field, red and green light are simultaneously emitted by means of the third and fourth light emitting diodes OLED3*b* and OLED4*b*.

When only one color light is emitted at one sub-field, color separation occurs. In the embodiments shown in FIGS. 8A-8D, red and green light are simultaneously emitted at respective sub-fields. In a total image display device, red, green, and blue light are emitted at respective sub-fields, thereby preventing color separation from occurring.

Although a few embodiments of the present invention have been shown and described, it would be appreciated by those skilled in the art that changes might be made in this embodiment without departing from the principles and spirit of the invention, the scope of which is defined in the claims and their equivalents.

In accordance with embodiments of the light emitting display of the present invention, since a plurality of light emitting diodes are connected to one pixel circuit, the number of pixel circuits in a light emitting display is reduced. Thus, an image is displayed by means of a smaller number of pixel circuits. As the number of the pixel circuits is reduced, the numbers of scan lines, data lines, and light emitting control lines are reduced. Accordingly, since a scan driver and a data driver can be embodied in a smaller size, thereby reducing unnecessary space taken up by the display. Furthermore, as the amount of wiring is reduced, the aperture ratio of a light emitting display is improved. In addition, a light emitting order of light emitting diodes is adjusted, thereby preventing color separation of the light emitting display from occurring.

Moreover, a time required for one light emitting diode to emit light is shortened. In order to maintain a uniform luminance, some embodiments use a greater current. Although a low gradation is displayed, the time required to charge the current can be reduced.

What is claimed is:

1. A pixel for emitting light corresponding to a data current from a data driver comprising:

a first light emitting diode;

a second light emitting diode;

a drive circuit coupled to the first light emitting diode and the second light emitting diode for generating a drive current that flows through the first light emitting diode and the second light emitting diode, the drive current corresponding to the data current;

a first switch circuit between the first light emitting diode and the drive circuit for transferring the drive current from the drive circuit to the first light emitting diode; and a second switch circuit between the second light emitting diode and the drive circuit for transferring the drive current from the drive circuit to the second light emitting diode, wherein the first light emitting diode and the second light emitting diode sequentially emit light, and wherein the drive circuit comprises:

a first transistor for allowing the drive current to flow according to a voltage applied to a gate of the first transistor;

a second transistor for selectively diode-connecting the first transistor according to a scan signal;

a third transistor for transferring a data current to the first transistor according to the scan signal; and a first capacitor for storing a voltage of a first level corresponding to the data current transferred from the first transistor.

2. The pixel as claimed in claim 1, wherein the drive circuit further comprises a second capacitor coupled in series to the first capacitor for changing the voltage of the first level stored in the first capacitor to a voltage of a second level.

3. The pixel as claimed in claim 1, wherein the voltage of the first level is a voltage corresponding to the drive current flowing through the first transistor.

4. The pixel as claimed in claim 2, wherein the voltage of the second level is a voltage divided by the first capacitor and the second capacitor when the second capacitor receives a boost signal.

5. The pixel as claimed in claim 4, wherein the boost signal is obtained by changing a voltage charged in the second capacitor when the second transistor is in a turning-on state.

6. A light emitting display comprising:

a pixel for emitting light corresponding to a data current from a data driver;

a first light emitting diode in the pixel;

a second light emitting diode in the pixel;

a third light emitting diode in the pixel;

a fourth light emitting diode in the pixel;

a drive circuit coupled to the light emitting diodes for generating a drive current flowing through the light emitting diodes corresponding to the data current; and a switch circuit assembly between the light emitting diodes and the drive circuit for sequentially controlling the drive current transferred to the light emitting diodes, wherein the drive circuit comprises:

a first transistor for allowing the drive current to flow according to a voltage applied to a gate of the first transistor;

a second transistor for selectively diode-connecting the first transistor according to a scan signal;

a third transistor for transferring the data current to the first transistor according to the scan signal; and a first capacitor for storing a voltage of a first level corresponding to the data current transferred to the first transistor.

7. The light emitting display as claimed in claim 6, wherein the drive circuit further comprises a second capacitor coupled in series to the first capacitor for changing the voltage of the first level stored in the first capacitor to a voltage of a second level.

8. A light emitting display comprising:

a pixel for emitting light corresponding to a data current from a data driver;

a first light emitting diode in the pixel;

a second light emitting diode in the pixel;

a third light emitting diode in the pixel;

a fourth light emitting diode in the pixel;

a drive circuit coupled to the light emitting diodes for generating a drive current flowing through the light emitting diodes corresponding to the data current; and a switch circuit assembly between the light emitting diodes and the drive circuit for sequentially controlling the drive current transferred to the light emitting diodes, wherein the switch circuit assembly includes a first switch circuit and a second switch circuit, wherein the first switch circuit comprises:

a first transistor for transferring the drive current according to a first light emitting control signal;

a second transistor for transferring the drive current transferred to the first transistor to the first light emitting diode according to a third light emitting control signal; and a third transistor for maintaining a state different from a state of the second transistor according to the third light emitting control signal and for transferring the drive current transferred by the first transistor to the second light emitting diode, and wherein the second switch circuit comprises:

a fourth transistor for transferring the drive current according to a second light emitting control signal;

a fifth transistor for transferring the drive current transferred by the fourth transistor to the third light emitting diode according to the third light emitting control signal; and a sixth transistor for maintaining a state different from the fifth transistor according to the third light emitting control signal and for transferring the drive current transferred by the fourth transistor to the fourth light emitting diode.

9. The light emitting display as claimed in claim 6, wherein the voltage of the first level is a voltage corresponding to the drive current flowing through the first transistor.

10. The light emitting display as claimed in claim 7, wherein the voltage of the second level is a voltage divided by the first capacitor and the second capacitor when the second capacitor receives a boost signal.

11. A light emitting display comprising:

an image display device including a first pixel;

a data driver for transferring a data signal to the first pixel; and a scan driver for transferring a scan signal, a first light emitting control signal, a second light emitting control signal, and a third light emitting control signal to the first pixel, wherein the first pixel comprises:

a first light emitting diode;

a second light emitting diode;

a drive circuit coupled to the first light emitting diode and the second light emitting diode for generating a drive current flowing through the first light emitting diode and the second light emitting diode corresponding to a data current;

a first switch circuit between the first light emitting diode and the drive circuit for transferring the drive current from the drive circuit to the first light emitting diode; and a second switch circuit between the second light emitting diode and the drive circuit for transferring the drive current from the drive circuit to the second light emitting diode, wherein the first light emitting diode and the second light emitting diode sequentially emit light, and wherein the drive circuit comprises a first transistor for allowing the drive current to flow according to a voltage applied to a gate of the first transistor; a second transistor for selectively diode-connecting the first transistor according to a scan signal; a third transistor for transferring the data current to the first transistor according to the scan signal; and a first capacitor for storing a voltage of a first level corresponding to the data current transferred to the first transistor.

12. The light emitting display as claimed in claim 11, wherein the drive circuit further comprises a second capacitor coupled in series to the first capacitor for changing the voltage of the first level stored in the first capacitor to a voltage of a second level.

13. The light emitting display as claimed in claim 11, wherein the voltage of the first level is a voltage corresponding to the drive current flowing through the first transistor.

14. The light emitting display as claimed in claim 12, wherein the voltage of the second level is a voltage divided by the first capacitor and the second capacitor when the second capacitor receives a boost signal.

15. The light emitting display as claimed in claim 14, wherein the scan driver transfers the boost signal.

16. The light emitting display as claimed in claim 11, further comprising a second pixel arranged adjacent to the first pixel and receiving the data signal through a same data line, wherein a light emitting order of the first light emitting diode and the second light emitting diode in the first pixel is different from that of a first light emitting diode and a second light emitting diode in the second pixel.

17. The light emitting display as claimed in claim 16, further comprising a third light emitting diode and a fourth light emitting diode in the first pixel and a third light emitting diode and a fourth light emitting diode in the second pixel, wherein a light emitting order of the third light emitting diode and the fourth light emitting diode in the first pixel is different from that of the third light emitting diode and the fourth light emitting diode in the second pixel.

18. A light emitting display comprising:

an image display device including a first pixel;

a data driver for transferring a data signal to the first pixel; and a scan driver for transferring a scan signal, a first light emitting control signal, a second light emitting control signal and a third light emitting control signal to the first pixel, wherein the first pixel comprises:

a first light emitting diode;

a second light emitting diode;

a third light emitting diode;

a fourth light emitting diode;

a drive circuit coupled to the light emitting diodes for generating a drive current flowing through the light emitting diodes corresponding to a data current;

a first switch circuit and a second switch circuit between the light emitting diodes and the drive circuit for sequentially controlling the drive current flowing through the light emitting diodes, wherein the drive circuit comprises a first transistor for allowing the drive current to flow according to a voltage applied to a gate of the first transistor; a second transistor for selectively diode-connecting the first transistor according to a scan signal; a third transistor for transferring the data current to the first transistor according to the scan signal; and a first capacitor for storing a voltage of a first level corresponding to the data current transferred to the first transistor.

19. The light emitting display as claimed in claim 18, wherein the drive circuit further comprises a second capacitor coupled in series to the first capacitor for changing the voltage of the first level stored in the first capacitor to a voltage of a second level.

20. A light emitting display comprising:

an image display device including a first pixel;

a data driver for transferring a data signal to the first pixel; and a scan driver for transferring a scan signal, a first light emitting control signal, a second light emitting control signal and a third light emitting control signal to the first pixel, wherein the first pixel comprises:

a first light emitting diode;

a second light emitting diode;

a third light emitting diode;

a fourth light emitting diode;

a drive circuit coupled to the light emitting diodes for generating a drive current flowing through the light emitting diodes corresponding to a data current;

a first switch circuit and a second switch circuit between the light emitting diodes and the drive circuit for sequentially controlling the drive current flowing through the light emitting diodes, wherein the first switch circuit comprises:

a first transistor for transferring the drive current according to a first light emitting control signal;

a second transistor for transferring the drive current transferred to the first transistor to the first light emitting diode according to a third light emitting control signal; and a third transistor for maintaining a state different from a state of the second transistor according to the third light emitting control signal and for transferring the drive current transferred by the first transistor to the second light emitting diode, and wherein the second switch circuit comprises:

a fourth transistor for transferring the drive current according to a second light emitting control signal;

a fifth transistor for transferring the drive current transferred by the fourth transistor to the third light emitting diode according to the third light emitting control signal; and a sixth transistor for maintaining a state different from the fifth transistor according to the third light emitting control signal and for transferring the drive current transferred by the fourth transistor to the fourth light emitting diode.

21. The light emitting display as claimed in claim 18, wherein the voltage of the first level is a voltage corresponding to the drive current flowing through the first transistor.

22. The light emitting display as claimed in claim 19, wherein the voltage of the second level is a voltage divided by the first capacitor and the second capacitor when the second capacitor receives a boost signal.

23. The light emitting display as claimed in claim 22, wherein the scan driver transfers the boost signal.

24. The light emitting display as claimed in claim 18, further comprising a second pixel arranged adjacent to the first pixel and receiving the data signal through a same data line, wherein a light emitting order of the first light emitting diode and the second light emitting diode of the first pixel is different from that of a first light emitting diode and a second light emitting diode of the second pixel, and a light emitting order of the third light emitting diode and the fourth light emitting diode of the first pixel is different from that of a third light emitting diode and a fourth light emitting diode of the second pixel.

* * * * *